United States Patent [19]

Lankheet

[11] 4,203,170

[45] May 20, 1980

[54] VINYL LINER AND SEALING GROOVE ASSEMBLY FOR POOLS

[76] Inventor: Jay A. Lankheet, 579 Ottawa Ave., Holland, Mich. 49423

[21] Appl. No.: 958,449

[22] Filed: Nov. 7, 1978

[51] Int. Cl.[2] ..... E04H 3/16

[52] U.S. Cl. ..... 4/172; 4/172.19; 52/169.7; 52/403

[58] Field of Search ..... 4/172, 172.19, 172.21, 4/177, 146; 52/169.7, 169.8, 403; 220/461

[56] References Cited

U.S. PATENT DOCUMENTS

| | | | |
|---|---|---|---|
| 3,100,556 | 8/1963 | Ridder | 4/172.19 X |
| 3,177,501 | 4/1965 | Kwake | 4/172 |
| 3,351,958 | 11/1967 | Shields | 4/172.21 |
| 3,354,473 | 11/1967 | Schwartz et al. | 4/172 |
| 3,739,539 | 6/1973 | Posnik | 4/172.19 |
| 3,750,197 | 8/1973 | Weir | 4/172.19 |
| 3,811,236 | 5/1974 | Fiddes | 4/172.21 X |
| 3,975,782 | 8/1976 | Lankheet | 4/172.19 X |
| 4,064,571 | 12/1977 | Phipps | 4/172.19 |

*Primary Examiner*—Stuart S. Levy

*Attorney, Agent, or Firm*—Price, Heneveld, Huizenga & Cooper

[57] ABSTRACT

The specification discloses a plastic pool wall having a groove in its face which includes an embedded metal channel for receiving the bead of a plastic pool liner. The metal channel includes spaced upper and lower walls joined by a base wall, with the upper wall terminating short of the plastic pool wall face. As a result, the upper surface of the groove is defined in part by the metal upper wall of the metal channel and by the plastic of the pool wall. Consequently, when the plastic liner bead is placed in the metal channel and the groove grouted, grout seals between the plastic pool liner and the plastic of the pool wall.

12 Claims, 1 Drawing Figure

VINYL LINER AND SEALING GROOVE ASSEMBLY FOR POOLS

BACKGROUND OF THE INVENTION

The present invention relates to pools made of plastic side walls and a plastic bottom liner. Such liners usually include a peripheral bead around the top edge thereof which is inserted into a groove in the pool plastic side wall.

Some manufactures mold the groove into the plastic side wall wherein the groove is defined entirely by the plastic material of which the side wall is made. The problem with this approach is that tolerances are difficult to maintain and accordingly, the liner often falls out of the groove during the life of the pool.

To overcome this, some artisans embed a metal channel in the plastic pool wall such that the metal channel defines the groove and close tolerances can be maintained. Where the groove is located above the water line, such an approach is fairly satisfactory.

However, many people prefer pool constructions wherein the plastic side walls are completely exposed and only the bottom of the pool is covered by a plastic liner. In such a case, the bead receiving groove and embedded metal channel in the plastic side wall have to be located towards the bottom of the plastic side wall below the waterline. Because of the differential expansion and contraction of the metal and plastic, and/or because of the difficulty of getting a good seal between the channel and the pool wall, water can leak around the upper channel wall and from thence all the way around the metal channel and into the space between the plastic wall and liner. This can cause errosion of the foundation of the pool, particularly where the bottom is merely sand, rather than concrete. It can cause unsightly bulges in the plastic pool bottom liner which may eventually lead to damage of the bulging portions. Finally, it can cause a nagging loss of water from the pool.

In my prior U.S. Pat. No. 3,975,782, I conceived a method for solving this problem which involved providing the plastic liner with a first bead for fitting into a metal channel groove in the pool side wall and a second bead located there above and joined thereto by an intervening flap. The second bead would be fitted into a plastic groove molded directly into the pool wall. The first bead and metal groove served to hold the bulk of the weight of the plastic pool liner while the second bead and plastic groove can be grouted to prevent water from leaking in behind the flap and metal channel. Because the upper groove is plastic, there is no expansion or contraction problem of the type encountered where the groove is defined by a metal channel.

While this prooved to be a satisfactory solution to the problem, it was not acceptable in all instances in that, even with most of the load being carried by the metal channel groove, a tolerance problem in the upper groove still allowed the upper flap to fall out of the groove from time to time.

SUMMARY OF THE INVENTION

In the present invention, I have overcome these difficulties by providing an embedded channel wherein the upper wall of the channel terminates short of the face of the pool wall. As a result, the upper surface of the bead receiving groove is defined in part by the upper wall of the channel and in part by the plastic material of which the plastic pool wall is made. Consequently, when the bead of the pool liner is located in the channel, grout can be inserted in the space between the bead and the plastic portion of the groove upper surface.

This greatly minimizes the possibility of water leaking in behind the channel upper wall. These and other objects, advantages and features of the present invention will be more fully understood and appreciated by reference to the written specification and appended drawings.

DESCRIPTION OF THE PREFERRED EMBODIMENT

Figure 1:
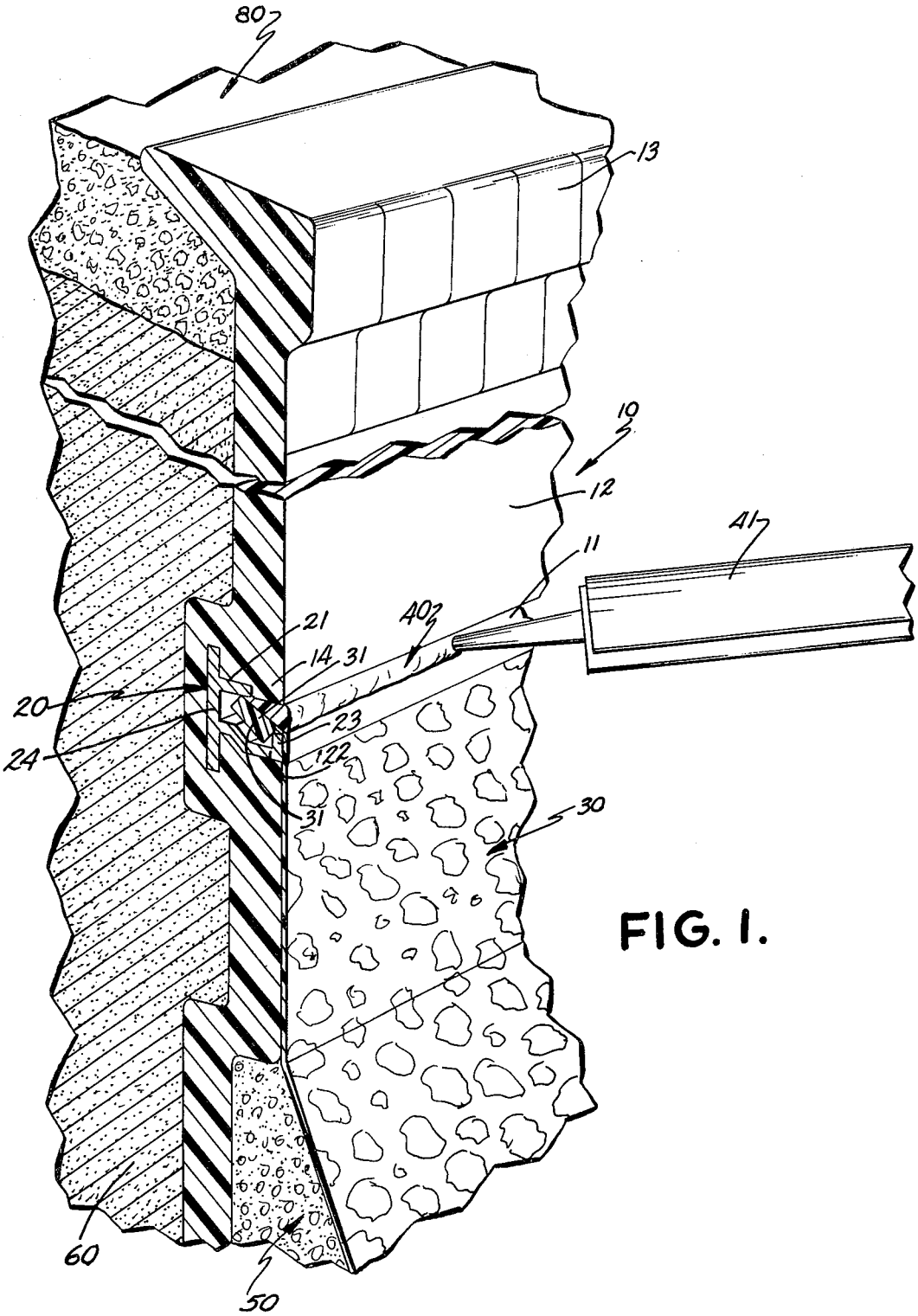
FIG. 1 is a perspective, partially cross sectional and broken view of a pool wall and sealing groove made in accordance with the present invention.

In the preferred embodiment, the plastic pool wall 10 includes a groove 11 with a channel 20 embedded therein (FIG. 1). Upper channel wall 21 stops short of the face 12 of pool wall 10. Liner 30 is hung in groove 11 by means of bead 31. Sealent 40 is forced into groove 11 between bead 31 and the upper plastic surface of groove 11 which is defined by nose 14. Liner 30 extends down from pool wall 10 and covers a sand or concrete pool bottom 50. Plastic wall 10 is backed by sand or dirt 60 and the top of plastic wall 10 is generally flush with the pool court surface such as concrete 80 or the like.

Plastic pool wall 10 is formed of fiberglass reinforced polyester resin. Its face 12 is either coated with a smooth, resinous plastic material such as "Gel-Kote" (TM), or comprises a thin vacuum formed acrylic layer. In such a situation, the acrylic layer would be shaped to define the face 12 of plastic pool wall 10. The term "face" as used herein is used to define the front or generally visible portion of plastic pool wall 10 when it is in use, rather than the rear surface of the wall. As is customary, plastic wall 10 is shaped to define a coping 13 at the top thereof. Finally, it is molded so as to define a groove 11 near the bottom thereof at a point which will be well below the waterline when the pool wall 10 is in use.

Groove 11 is formed with channel 20 embedded therein. Channel 20 is preferably an aluminum extrusion which includes a base wall 24, an upper wall 21 and a bottom wall 22. Upper wall 21 terminates short of face 12 of plastic pool wall 10. As a result, a portion of the plastic material of pool wall 10 extends down over the leading edge of upper wall 21 defining a plastic nose 14. The upper surface of groove 11 is thereby defined in part by upper wall 21 of channel 20 and by the plastic material of which pool wall 10 is made. Nose 14 also helps securely hold metal channel 20 in place and helps prevent water from leaking in around upper wall 21.

Channel 20 can be formed of materials other than aluminum so long as the materials and process of formation lend themselves to fairly close tolerances. For example, it is believed that an extruded rigid plastic material would be a suitable substitute for extruded aluminum.

Bottom wall 22 of channel 20 terminates at an upwardly turned lip 23. Lip 23 is located generally flush with face 12 of pool wall 10. Thus, lower wall 22 extends outwardly farther than upper wall 21.

Base wall 24 from which upper and lower walls 21 and 22 extend, does itself extend laterally beyond upper and lower walls 21 and 22. This helps to more firmly anchor channel 20 in place and also acts as a guard to assist in preventing water creepage around channel 20, although the later is primarily prevented by the unique relationship of metal upper wall 21 and plastic nose 14. Base wall 24 extends as far beyond its juncture with upper wall 21 as it does from its juncture with bottom wall 22. Accordingly, bottom wall 22 extends first laterally outwardly from base wall 24 and then slopes downwardly and then forwardly again so as to increase the vertical width of groove 11 in the area where plastic bead 31 must be inserted.

Plastic liner 30 is comprised of a thin, tough flexible plastic material. Plastic bead 31 is heat sealed to the upper circumferential edge of liner 30 and projects laterally from at least the rear surface of liner 30 so that it will hook over the lip 23 of channel 20. Typically, both liner 30 and bead 31 are made of polyvinyl chloride plastic material.

Sealant 40 can be any of a number of different types of plastic sealants such as a silicone sealant or other type of plastic coating. Such sealants have been frequently used before in connection with pools for sealing the joints between adjacent pool wall segments.

In operation, once all of the segments of plastic pool wall 10 are in place in the ground, plastic liner 30 is placed in the bottom of the pool and bead 31 is inserted into groove 11 in face 12 of plastic wall 10. The relative dimensions of bead 31, channel bottom wall 22 and channel upper wall 21 are such that bead 31 will engage both lip 23 and upper wall 21. Because bead 31 so engages channel 20 and thereby relies solely on channel 20 to properly hold it in place, tolerance problems are minimized. It is much easier to hold the tolerance on an extruded channel 20 than it would be in an integrally formed plastic groove wherein bead 31 would engage the formed plastic walls of such a groove.

Yet, because upper wall 21 terminates short of face 12 of plastic wall 10, approximately half of the upper surface of groove 11 is defined by plastic material of which pool wall 10 is made. Specifically it is defined by plastic nose 14. When the operator then injects the silicone or other caulking 40 into groove 11, using a caulking gun 41, he can be sure that the caulking will engage bead 31 on one hand and plastic nose 14 on the other hand. As a result, the differential contraction and expansion which might ocurr between channel 20 and its surrounding plastic wall 10 and/or any other seating problems between the same are rendered unimportant since the seal 40 does not rely on contact between the channel on the one hand and the plastic pool wall on the other. Rather, sealing is snugly effected between plastic bead 31 and plastic nose 14.

Of course, it is understood that the above is merely a preferred embodiment of the invention and that various changes and alterations can be made without departing from the spirit and broader aspects thereof as defined by the appended claims, interpretted in accordance with the principles of law and the doctrine of equivalents.

The embodiments of the invention in which an exclusive property or privilege is claimed are defined as follows.

1. A plastic pool wall having a groove in its face which includes a separate embedded channel receiving the bead of a plastic pool liner, the improvement comprising: said channel including spaced upper and lower walls joined by a base wall, said upper wall terminating short of said pool wall face such that the upper surface of said groove is defined in part by said channel upper wall and by the plastic material of said pool wall, said lower wall of said channel being bent up to define a lip at the end of said lower wall to catch said bead, the relative size of said bead and the distance between said lip and said leading edge of said upper wall of said channel being such that said bead catches on said lip and abuts the lower surfaces of said upper wall of said channel whereby said bead is locked in place solely through contact with said channel, grout sealant located in said groove between said plastic liner and said plastic portion of the upper surface of said groove, whereby when said liner bead is placed in said channel and grouted within said groove, grout seals between said plastic pool liner and said plastic of said pool wall.

2. The plastic pool wall of claim 1 in which a plastic nose extends downwardly over the leading edge of said upper wall of said channel.

3. The plastic pool wall of claim 2 in which said lip on said lower wall of said channel is located at the face of said pool wall and is generally flush therewith.

4. The pool wall of claim 3 wherein said groove is located below the intended waterline of said plastic pool wall.

5. The pool wall of claim 5 wherein said channel is metal.

6. The plastic pool wall of claim 3 wherein said base wall of said channel extends laterally beyond said upper and lower channel walls.

7. The plastic pool wall of claim 6 wherein said lower wall of said channel extends from said base wall at a point such that the lateral extension of said base wall is equal beyond said upper wall and said lower wall, said lower wall then sloping downwardly at a point spaced from said base wall, then extending generally horizontally forwardly again and finally extending vertically upwardly to define said lip whereby proper spacing can be achieved between the said upper and lower walls and said upper wall and said lip.

8. The plastic pool wall of claim 1 in which said lip on said lower wall of said channel is located at the face of said pool wall and is generally flush therewith.

9. The pool wall of claim 8 wherein said channel is metal.

10. The pool wall of claim 1 wherein said channel is metal.

11. The pool wall of claim 1 wherein said groove is located below the intended waterline of said plastic pool wall.

12. The pool wall of claim 10 wherein said channel is extruded aluminum.

* * * * *

UNITED STATES PATENT AND TRADEMARK OFFICE

CERTIFICATE OF CORRECTION

PATENT NO. : 4,203,170

DATED : May 20, 1980

INVENTOR(S) : Jay A. Lankheet

It is certified that error appears in the above—identified patent and that said Letters Patent is hereby corrected as shown below:

Column 3, line 35, "tolerance" should read -- tolerances --.

Column 4, line 34, "5" should read -- 4 --.

Signed and Sealed this

*Seventh* Day of *October 1980*

[SEAL]

*Attest:*

SIDNEY A. DIAMOND

*Attesting Officer*

*Commissioner of Patents and Trademarks*